US010779596B1

(12) United States Patent
Warra et al.

(10) Patent No.: US 10,779,596 B1
(45) Date of Patent: Sep. 22, 2020

(54) HAND-HELD FACEMASKS

(71) Applicants: Jerry S. Warra, Livonia, MI (US); Linda E. Warra, Livonia, MI (US)

(72) Inventors: Jerry S. Warra, Livonia, MI (US); Linda E. Warra, Livonia, MI (US)

( * ) Notice: Subject to any disclaimer, the term of this patent is extended or adjusted under 35 U.S.C. 154(b) by 490 days.

(21) Appl. No.: 15/389,467

(22) Filed: Dec. 23, 2016

Related U.S. Application Data

(62) Division of application No. 14/251,614, filed on Apr. 13, 2014, now Pat. No. 9,532,619.

(60) Provisional application No. 61/811,716, filed on Apr. 13, 2013.

(51) Int. Cl.
*A41G 7/00* (2006.01)

(52) U.S. Cl.
CPC ..... *A41G 7/00* (2013.01)

(58) Field of Classification Search
CPC ..... A41G 7/00; A42B 1/004
See application file for complete search history.

(56) References Cited

U.S. PATENT DOCUMENTS 211,675 A * 1/1879 Weidmann ..... A41D 13/11 2/206
1,750,937 A * 3/1930 Morgan ..... A45D 44/12 132/212
1,764,912 A * 6/1930 Caster-Udell ..... A45D 44/12 132/212
2,424,352 A * 7/1947 Conjurske ..... A45D 44/12 2/174
2,677,133 A * 5/1954 Hoffman, Jr. ..... A41G 7/00 2/206
3,089,148 A * 5/1963 Grossberg ..... A41G 7/00 2/206
3,555,559 A * 1/1971 Hundhausen ..... A45D 44/12 2/11
3,602,913 A * 9/1971 Neese ..... A45D 44/12 2/9
4,223,407 A * 9/1980 Zappala ..... A45D 44/12 2/174
5,014,353 A * 5/1991 Brown ..... A61F 9/06 2/11
D321,957 S * 11/1991 Brown ..... D29/110
5,652,963 A * 8/1997 Davison ..... A41G 7/00 2/206
5,797,141 A * 8/1998 Morlett ..... A45D 44/12 2/174
6,155,967 A * 12/2000 Catlett ..... A61N 2/06 128/857
6,530,659 B1 * 3/2003 Marcum ..... A61F 9/02 351/156
2007/0094770 A1 * 5/2007 Ciesinski ..... A45D 44/12 2/174
2011/0219507 A1 * 9/2011 Choi ..... A41D 13/1161 2/9

* cited by examiner

*Primary Examiner* — Khaled Annis
(74) *Attorney, Agent, or Firm* — George L. Boller

(57) ABSTRACT

Designs and constructions for facemasks which, when properly used, can enable a small child's head hair to be washed by a parent without interference by the child while preventing liquid being applied to the head hair from washing across eyes, nose and mouth. The facemask has handgrips at either side which are grasped by the hands of the child while the child presses a seal against his/her forehead. The facial designs of the masks present artistic renderings of animals' faces, cartoon characters, etc.

12 Claims, 10 Drawing Sheets

HAND-HELD FACEMASKS

DOMESTIC PRIORITY CLAIM

This application claims priority of pending patent application Ser. No. 14/251,614 filed Apr. 13, 2014, now U.S. Pat. No. 9,532,619 issued Jan. 3, 2017, which claims priority of Provisional Patent Application No. 61/811,716 filed Apr. 13, 2013.

FIELD

The present disclosure relates to facemasks.

BACKGROUND

It is known to cover at least a portion of a person's face when certain substances are being applied to a person's scalp, such as when the person's hair and/or scalp is/are being treated and/or washed and rinsed.

A purpose of doing so is to protect a person's eyes, nose, and/or mouth from liquid or substances which may be carried by a liquid.

SUMMARY OF THE DISCLOSURE

Some persons, small children for example, may be unable to wash their own hair, and consequently they depend on another person to do so. A responsible adult whose hair is being washed is unlikely to interfere with washing of his/her own hair by another person. That is not necessarily true of a young child.

The inventors have created designs and constructions for facemasks which, when properly used, can enable a small child's hair to be washed by a parent or other older person without interference by the child while preventing liquid being applied to the scalp and hair from washing across eyes, nose and mouth. For purposes of description in the present disclosure, a parent can be considered a second person and a child a first person.

These designs and constructions are intended to be grasped by both hands of the first person to whose scalp and hair liquid is being applied by the second person.

Applicants' priority patent application Ser. No. 14/251,614 discloses and claims a method of using a facemask which enables a second person to wash a first person's scalp and hair without manual interference by the first person.

The present Patent Application relates to a facemask which is useful in practicing the method of Applicants' priority Patent Application, but can also be used by itself, such as for play.

Various embodiments of facemask comprise a mask body comprising a concave posterior surface which has a shape for anterior placement over at least a person's forehead, eyes, cheeks, nose and mouth.

The mask body has a superior margin, an inferior margin, a right lateral margin disposed laterally to the right beyond the eyes, cheeks and mouth and extending between the superior margin and the inferior margin, and a left lateral margin disposed laterally to the left beyond the eyes, cheeks and mouth and extending between the superior margin and the inferior margin.

The right lateral margin comprises a right wall which a) extends laterally outward to the right from the concave posterior surface, b) comprises a right handgrip laterally spaced from the concave posterior surface and large enough for grasping by a person's right hand, and c) has a posterior surface extending from the concave posterior surface at an angle to the concave posterior surface which is greater than a straight angle.

The left lateral margin comprises a left wall which a) extends laterally outward to the left from the concave posterior surface, b) comprises a left handgrip laterally spaced from the concave posterior surface and large enough for grasping by a person's left hand, and c) has a posterior surface extending from the concave posterior surface at an angle to the concave posterior surface which is greater than a straight angle.

A seal is disposed on the concave posterior surface and extends along the superior margin between the right and left margins for sealing the mask body to a person's forehead.

In one embodiment, the right handgrip is defined by a right through-slot in the mask body through which fingers of a person's right hand can extend, and the left handgrip is defined by a left through-slot in the mask body through which fingers of a person's left hand can extend.

The foregoing summary is accompanied by further detail of the disclosure presented in the Detailed Description below with reference to the following drawings which are part of the disclosure.

DETAILED DESCRIPTION

Figure 1:
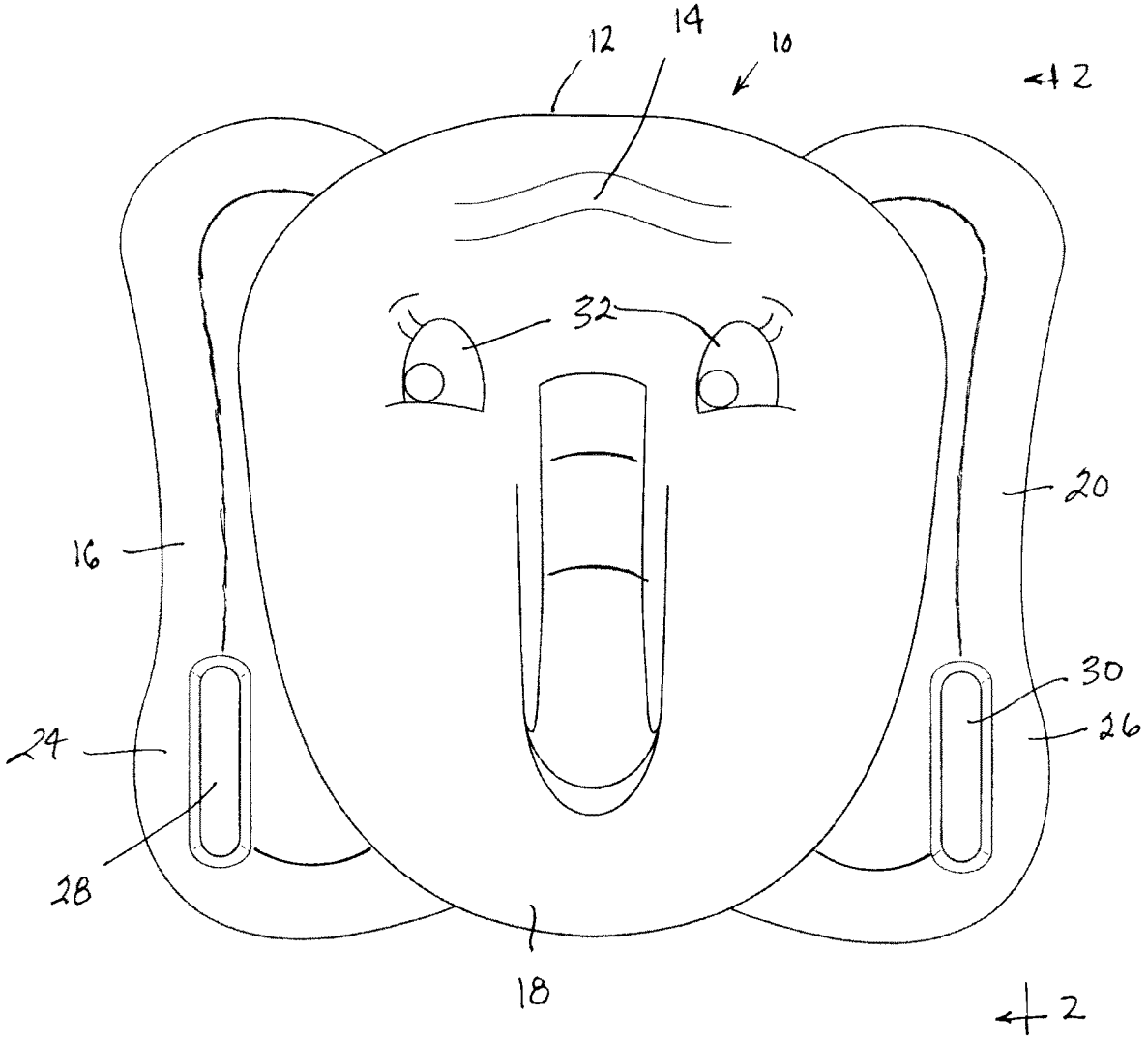
FIG. 1 is a front view of one embodiment of facemask.
Figure 2:
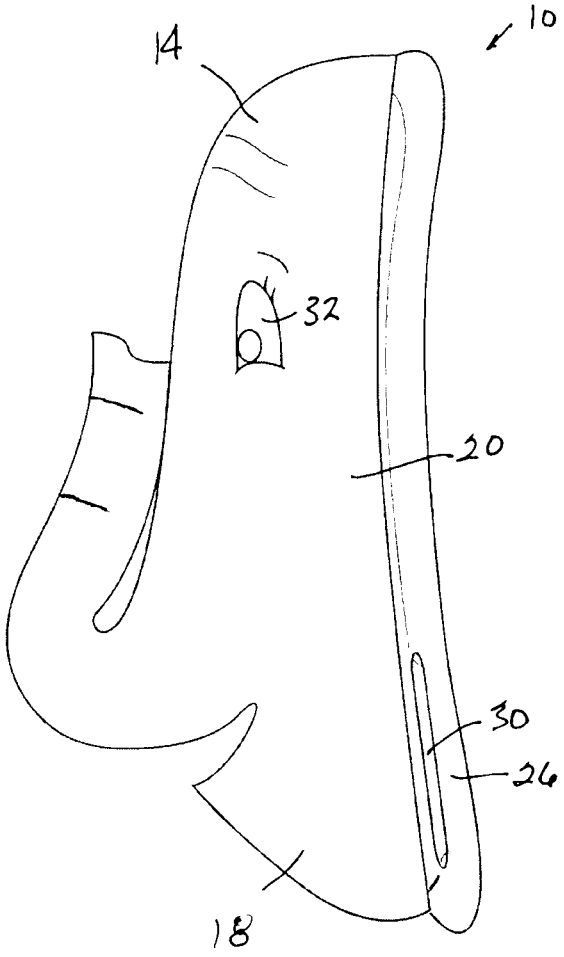
FIG. 2 is a left side view of FIG. 1 in the direction of arrows 2-2 in FIG. 1.

FIGS. 1-4 show a facemask 10 having a mask body 12 having a concave posterior surface shaped for anterior placement over at least a person's forehead, eyes, cheeks, nose and mouth. The mask body which is illustrated in FIGS. 1-4 covers the forehead, eyes, cheeks, nose, and mouth. The mask body has an anterior surface which presents a facial appearance.

Mask body 12 has a superior margin 14 which leaves a person's scalp uncovered so as to allow liquid to be applied to the scalp and its hair.

Mask body 12 also has a right margin 16 disposed laterally of the medial plane beyond the eyes, cheeks and mouth and extending inferiorly from superior margin 14 to an inferior margin 18 of mask body 12, and a left margin 20 disposed laterally of the medial plane beyond the eyes, cheeks and mouth and extending inferiorly from superior margin 14 to inferior margin 18.

A seal 22 is disposed on a posterior surface of superior margin 14 and extends between right margin 16 and left margin 20 for sealing mask body 12 to a persons forehead along superior margin 14 to prevent intrusion of liquid between mask body 12 and the person's forehead.

A right handgrip 24 joins with right margin 16 which is large enough for grasping by a person curling fingers of his/her right hand around the right handgrip 24. A left handgrip 26 joins with left margin 20 and is large enough for grasping by a person curling fingers of his/her left hand around the left handgrip.

Right handgrip 24 is defined by a right through-slot 28 in mask body 12 through which fingers of a person's right hand can extend. Left handgrip 26 is defined by a left through-slot 30 in mask body 12 through which fingers of a person's left hand can extend.

The embodiment shown presents a facial appearance corresponding to that of an artistic rendering of an animal character, an elephant in this instance. Such embodiments are intended to encourage use of the masks by young children.

The eyes 32 are transparent material which allows the user to see through the mask and the mask body has one or more air holes 34 which allow the user to breathe freely without drawing in liquid.

Figure 4:
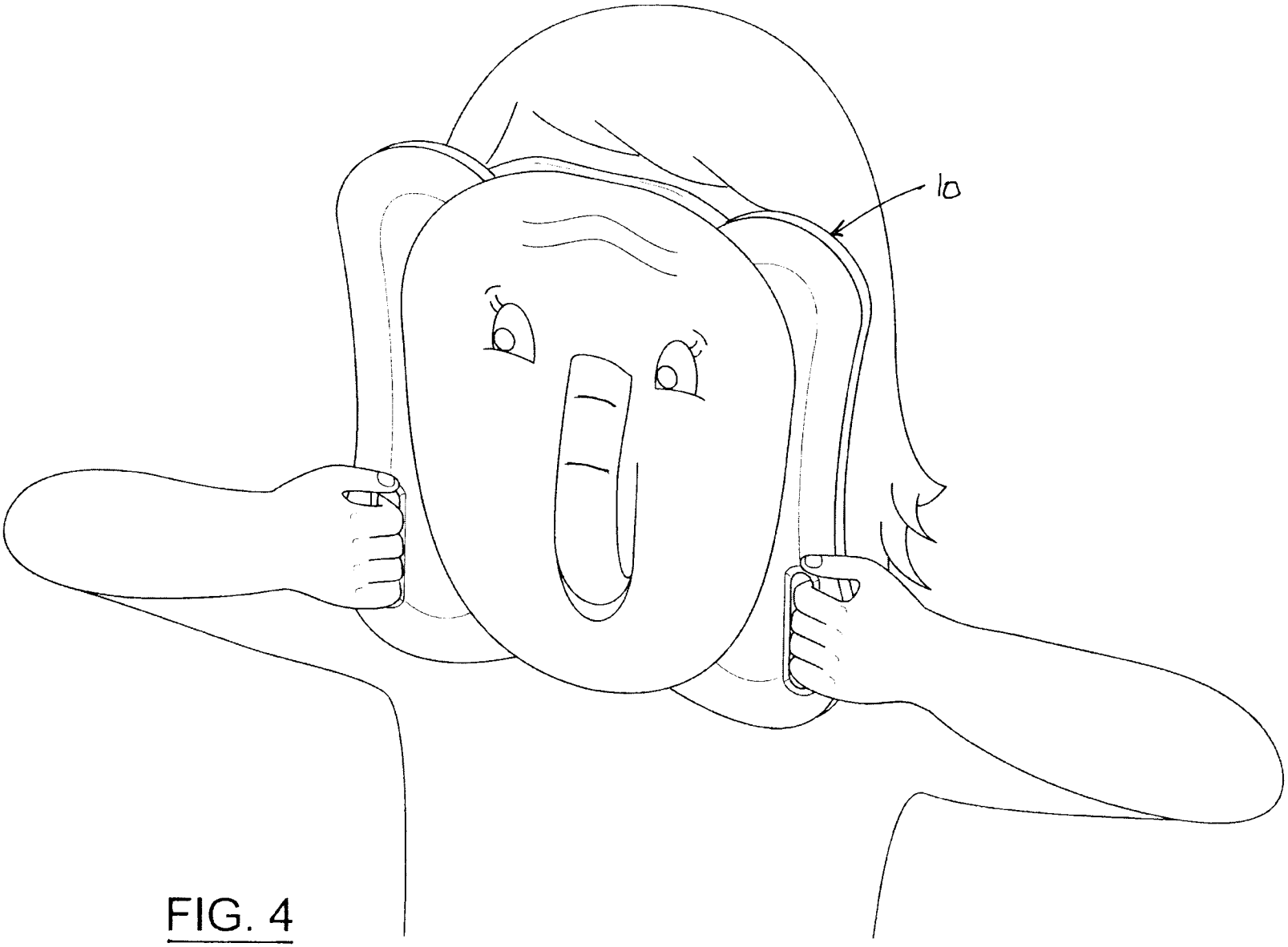
FIG. 4 is a perspective view illustrating use of the facemask.

FIG. 4 shows mask 10 in use over a child's face. The child's hands grasp the handgrips 24, 26 and hold mask 10 over his/her face while pressing seal 22 against his/her forehead.

Other designs and constructions which are contemplated, but not necessarily illustrated in the Figures, include: Dolphin and Turtle where the anterior surface of the mask is that of the character's face and a fin extends from the mask body at each of the right and left sides allowing the fins themselves to be the hand grips. Alternately and as will be explained later, through-slots can be added to create the handgrips.

Still other constructions which have through-slots forming the handgrips include: Zebra and Horse (members of the genus *Equus*), Gorilla, Monkey, Grizzly Bear, Giraffe, Panda Bear, Polar Bear, Tiger, Lion, Raccoon, Dog and Cat. These masks show the animal's face with the handgrips on either side.

For an Octopus, the mask is constructed in a way to allow the eight legs of the octopus to be split four on the right side and four on the left side of the mask for use as the handgrips.

For a Camel, the mask shows the face with the animal's ears protruding on the right and left sides to be used as the handgrips.

Features such as fins, legs, and ears are understood as appendages of the animal character represented by the particular face.

Other mask bodies may present outward appearances of recognizable fictional characters, such as cartoon characters for example, or the face of an actual or fictional person.

The embodiments of the various Figures and accompanying descriptions, especially the embodiment of FIGS. 1-4, disclose that the right lateral margin comprises a right wall which extends to the right of the concave interior of the mask body which fits over the first person's face and the left lateral margin comprises a left wall which extends to the left of the concave interior of the mask body which fits over the first person's face. In FIGS. 1-4 those walls are the elephant's ears which are spaced laterally outward of the concave interior of the mask body.

Figure 3:
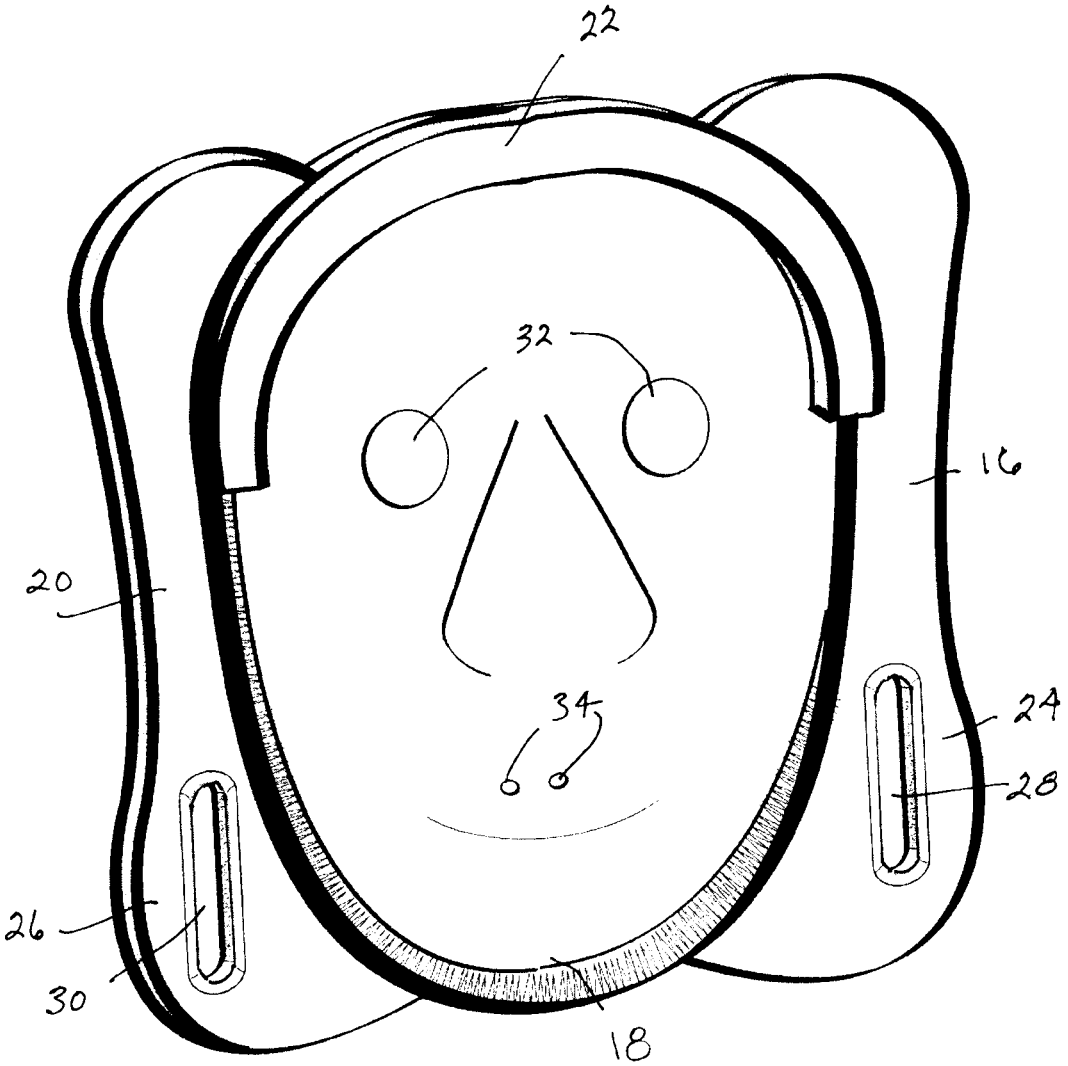
FIG. 3 is perspective view from the rear.

FIG. 3 shows that the concave interior of the mask body has a concave posterior surface. It also shows that the right wall which contains the right handgrip has a posterior surface extending from the posterior surface of the concave interior of the mask body and that the left wall which contains the left handgrip has a posterior surface extending from the posterior surface of the concave interior of the mask body. The angle at which the posterior surface of each wall extends from the posterior surface of the concave interior of the mask body is greater than a straight angle, and is in fact significantly greater.

FIGS. 5-7 and 9 show another facemask having a mask body 48 comprising bottom mask part 50, a top mask part 52, and a seal 54. Bottom mask portion 50 has a lop edge 56 which fits congruently to a bottom edge 58 of top mask part 52 so that the anterior surface of the two fitted-together parts 50, 52 forms the complete mask body 48 having a face of an animal character. A generally concave posterior surface of the parts 50, 52 fits over at least a person's forehead, eyes, cheeks, nose and mouth. The facemask which is illustrated covers the forehead, eyes, cheeks, nose, mouth, and chin.

Top mask part 52 forms a superior margin which leaves a person's scalp uncovered so as to allow liquid to be applied to the scalp and its hair. Collectively, bottom mask part 50 and top mask part 52 provide the facemask with a right margin disposed laterally of the medial plane beyond the eyes, cheeks, mouth, and chin and extending inferiorly from the superior margin to an inferior margin which is contained entirely in bottom mask part 50. Collectively, parts 50 and 52 provide the facemask with a left margin disposed laterally of the medial plane beyond the eyes, cheeks, mouth, and chin and extending inferiorly from the superior margin to the inferior margin.

Seal 54 runs along top edge 56 and bottom edge 58 between a location (reference numeral 62) below and laterally outward of the facemask's right eye and a location (reference numeral 64) below and laterally outward of the mask's left eye. With bottom and top parts 50, 52 fit together, seal 54 is not seen when looking toward the front of the facemask as in FIG. 5.

Figure 9:
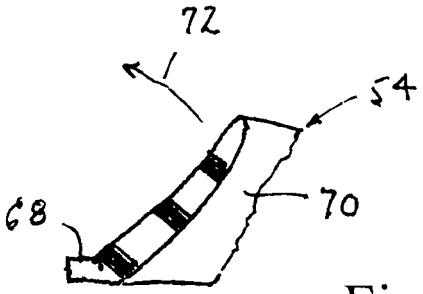
FIG. 9 is a fragmentary cross section view showing shape of a seal at its midpoint above the nose.
Figure 10:
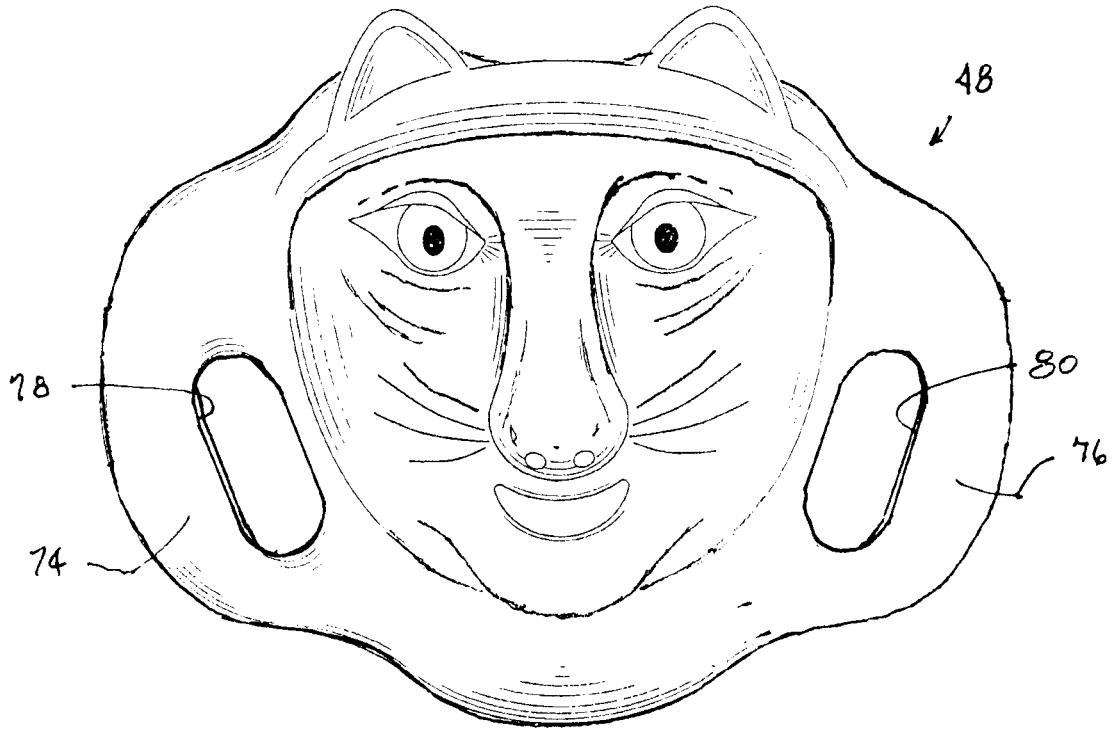
FIG. 10 is a front view of still another embodiment.
Figure 11:
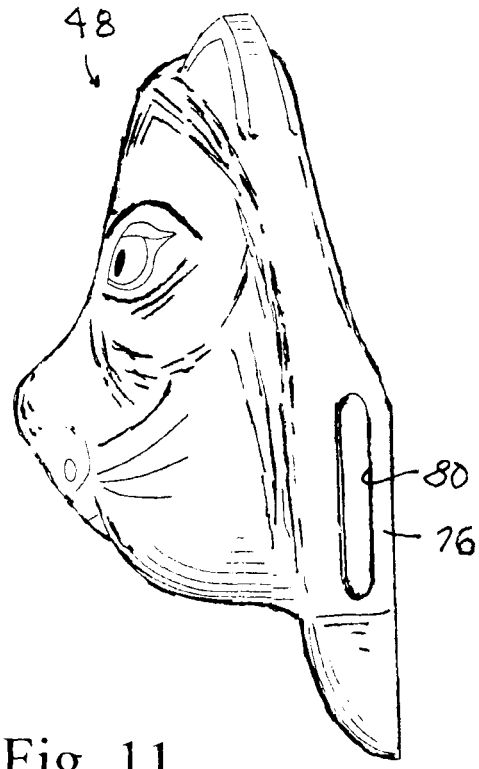
FIG. 11 is a side view of the left side of FIG. 10.
Figure 12:
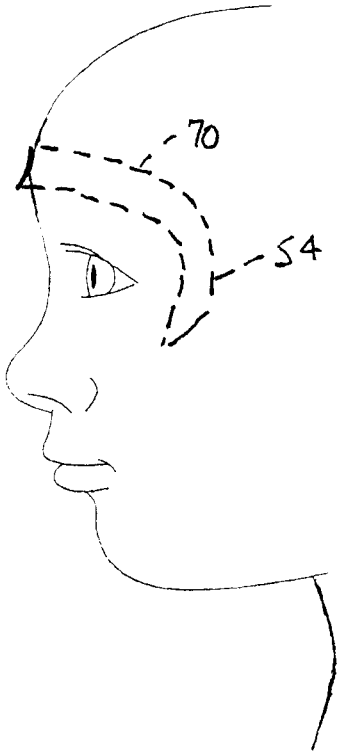
FIG. 12 is a left side view of a child's face.

FIG. 9 shows the cross section shape of seal 54 at its midpoint above the nose. From the midpoint the seal runs along generally horizontal, but slightly curved portions 66 of edges 56, 58 before turning downward and slightly outward toward lengthwise ends the seal at 62 and 64. Laterally outward beyond ends of seal 54, edges 56, 58 are essentially horizontal as they curve rearward and outward in both right and left margins.

The portion of seal 54 running generally horizontal has a base 68 which is trapped between edges 56, 58. In addition to being mechanically trapped, it may be adhered to one or both mask parts 50, 52. A sealing lip 70 extends upward and rearward from base 68 beyond top edge 56. Sealing lip 70 may have an upwardly concave shape as shown. Seal 54 is molded to its shape by molding material which when cured is elastomeric, such as silicone rubber, which allows sealing lip 70 to flex in the sense indicated by arrow 72 in FIG. 9.

Bottom and top mask parts 50, 52 may be held fast together in any of various ways, such as by incorporating features which allow them to be snapped together without using fasteners, features which will accept fasteners, and/or features which allow them to be adhesively joined or bonded together. Such features are located so as to not interfere with the sealing of the facemask to a person's face as described herein.

A right handgrip 74 in bottom part 50 is large enough for grasping by a person curling fingers of his/her right hand around it. A left handgrip 76 is large enough for grasping by a person curling fingers of his/her left hand around it.

Each handgrip is defined by a respective through-slot 78, 80 through which fingers of a person's respective hand can extend.

Figure 7:
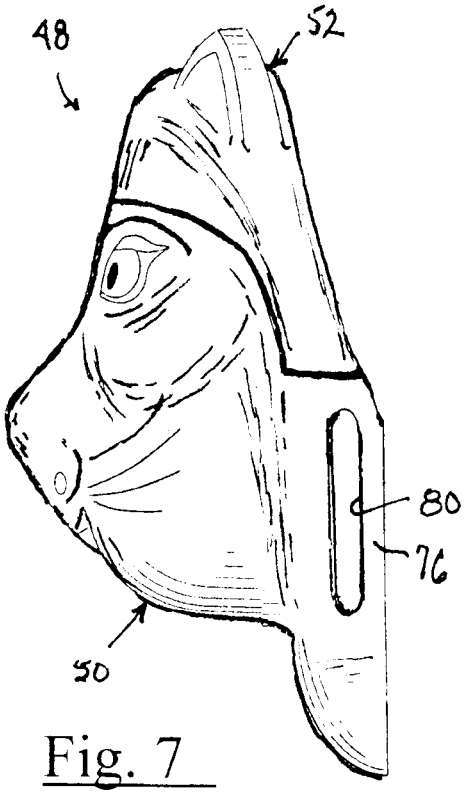
FIG. 7 is a side view of the left side of FIG. 5.
Figure 8:
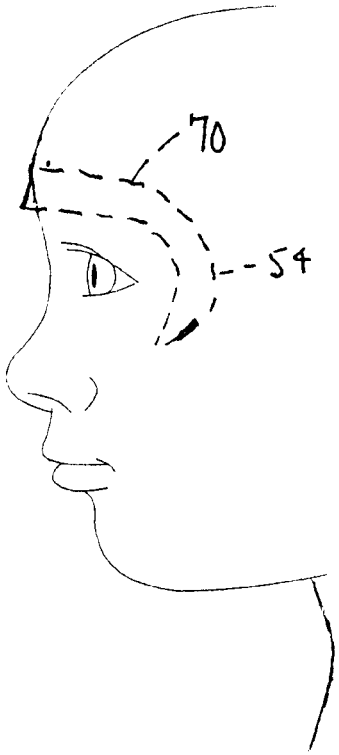
FIG. 8 is a left side view of a child's face.

When used, the mask is grasped with both hands by a person to whose hair a liquid is to be applied and is placed over his/her face with corresponding parts of the mask face in approximate registration with the person's eyes, nose, cheeks, mouth, and chin as suggested by FIGS. 7 and 8. Sealing lip 70 is pressed against the forehead, flexing it slightly into sealing contact with the forehead. Where seal 54 begins to turn downward, sealing lip 70 ends by merging into sides of seal 54 which are thick enough laterally to seal against the person's temples and which extend downward below the level of the person's eyes. In this way the mask is sealed to the forehead from a location laterally outward of one eye to a location laterally outward of the other eye and then downward along the temples to a point below the eyes as suggested in FIG. 8 where sealing lip 70 is shown in phantom.

Figure 5:
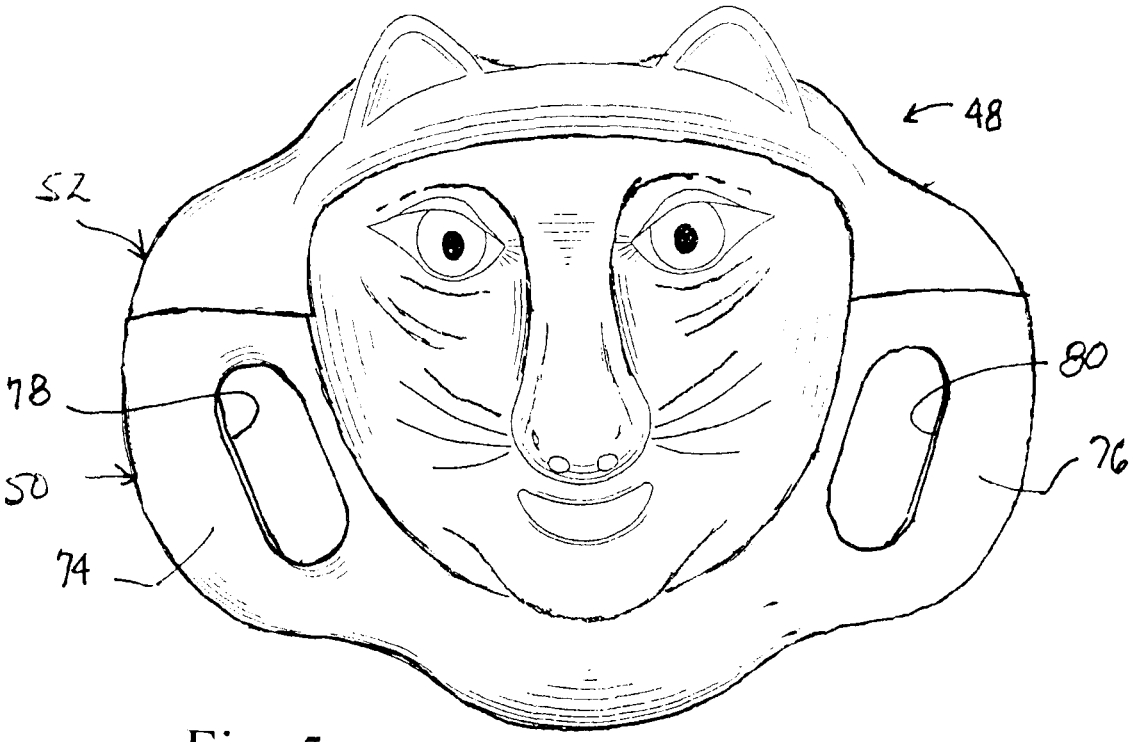
FIG. 5 is a front view of still another embodiment.
Figure 6:
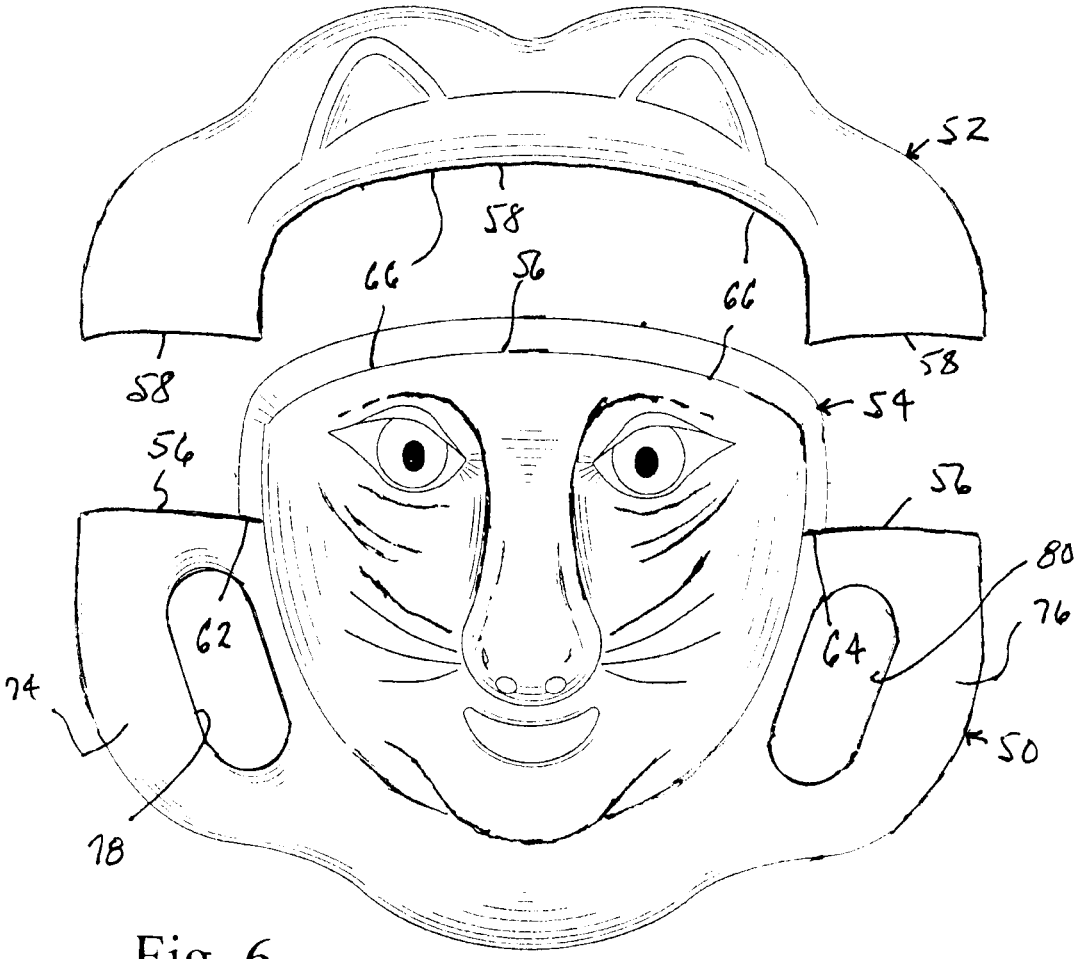
FIG. 6 is an exploded view of FIG. 5.
Figure 15:
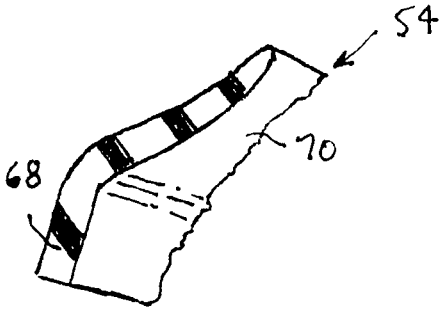
FIG. 15 is an enlarged cross section view of a seal of the embodiment of FIGS. 13 and 14 taken in a in the direction of arrows 15-15 in FIG. 13.
Figure 14:
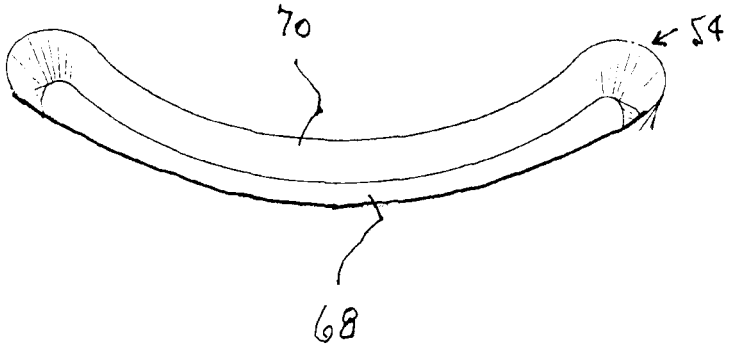
FIG. 14 a fragmentary cross section view in the direction of arrows 14-14 in FIG. 13.

FIGS. 10, 11, and 13-15 show a facemask like the one in FIGS. 5-7 but having a one-piece mask body which in all material respects is identical to mask body 48. FIG. 15 shows the cross section shape of seal 54 at its midpoint above the nose. Seal 54 of FIG. 15 places its sealing lip 70 in the same position as described in FIGS. 5-7 but has a different shaped base 68.

Base 68 is assembled to the posterior surface of the margin of top edge 56 in any suitably appropriate way such as by adhesive and/or fasteners. Sealing lip 70 extends upward and rearward from base 68 to place sealing lip 70 on the person's face in the same location as in FIG. 8.

Figure 16:
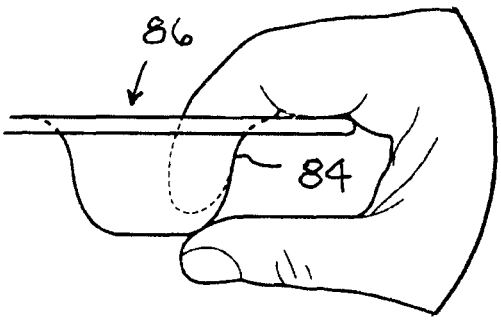
FIGS. 16 and 17 show a modified form of handgrip.
Figure 17:
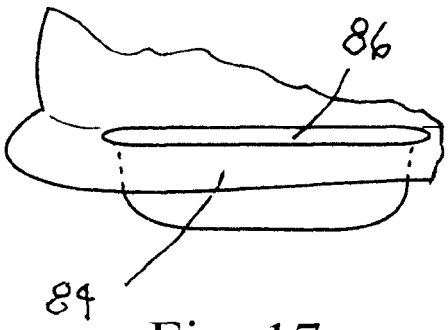
Figure 13:
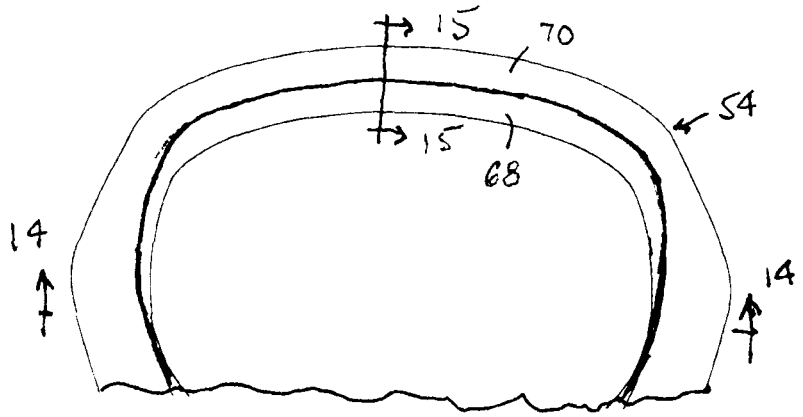
FIG. 13 is a fragmentary rear view of a seal.

FIGS. 16 and 17 show a modified form of handgrip 84 which is formed by a depression 86 in the mask body rather than a through-slot as in the previous Figures. The mask body itself can be fabricated by molding of a suitable plastic material which when cured will be fairly rigid, but may have a slight degree of flexibility.

What is claimed is:

1. A facemask comprising:

a mask body comprising a concave posterior surface which has a shape for anterior placement over at least a person's forehead, eyes, cheeks, nose and mouth;

the mask body having a superior margin, an inferior margin, a right lateral margin disposed laterally to the right beyond the eyes, cheeks and mouth and extending between the superior margin and the inferior margin, and a left lateral margin disposed laterally to the left beyond the eyes, cheeks and mouth and extending between the superior margin and the inferior margin;

the right lateral margin comprising a right wall which a) extends laterally outward to the right from the concave posterior surface, b) comprises a right handgrip laterally spaced from the concave posterior surface and large enough for grasping by a person's right hand, and c) has a posterior surface extending from the concave posterior surface at an angle to the concave posterior surface which is greater than a straight angle;

the left lateral margin comprising a left wall which a) extends laterally outward to the left from the concave posterior surface, b) comprises a left handgrip laterally spaced from the concave posterior surface and large enough for grasping by a person's left hand, and c) has a posterior surface extending from the concave posterior surface at an angle to the concave posterior surface which is greater than a straight angle; and a seal disposed on the concave posterior surface and extending along the superior margin between the right and left margins for sealing the mask body to a person's forehead.

2. A facemask as set forth in claim 1 in which the right handgrip is defined in part by a right through-slot in the right wall through which fingers of a person's right hand can extend, and the left handgrip is defined in part by a left through-slot in the left wall through which fingers of a person's left hand can extend.

3. A facemask as set forth in claim 1 in which the facemask comprises an anterior surface which presents an appearance corresponding to that of the face of a recognizable fictional character.

4. A facemask as set forth in claim 1 in which the facemask comprises an anterior surface which presents an appearance corresponding to that of the face of a person.

5. A facemask as set forth in claim 1 in which the facemask comprises an anterior surface which presents an appearance corresponding to that of the face of an animal.

6. A facemask as set forth in claim 5 in which each wall is visually recognizable as an appendage of an animal.

7. A facemask as set forth in claim 6 in which each wall is visually recognizable as a mane of an animal belonging to the *equus* genus.

8. A facemask as set forth in claim 6 in which each wall is visually recognizable as ears of an animal.

9. A facemask as set forth in claim 2 in which the mask body has transparent eyes which enable a person to see through the mask body.

10. A facemask as set forth in claim 2 in which the mask body has one or more air holes for enabling a person to breathe through the mask body.

11. A facemask as set forth in claim 2 in which the seal has a base disposed on the concave posterior surface and a sealing lip extending upward and rearward from the base for sealing against a person's forehead and resiliently compressing into sealing contact with a person's temples as the seal seals against the person's forehead.

12. A facemask as set forth in claim 2 in which the seal also extends downward along the right and left margins to a level below the person's eyes.

* * * * *